US009748628B1

(12) United States Patent
Hiller

(10) Patent No.: US 9,748,628 B1
(45) Date of Patent: Aug. 29, 2017

(54) MULTIDIRECTIONAL COMMUNICATION ASSEMBLY

(75) Inventor: Nathan D. Hiller, Irvine, CA (US)

(73) Assignee: The Boeing Company, Chicago, IL (US)

( * ) Notice: Subject to any disclaimer, the term of this patent is extended or adjusted under 35 U.S.C. 154(b) by 1207 days.

(21) Appl. No.: 13/618,473

(22) Filed: Sep. 14, 2012

(51) Int. Cl.
*H01Q 1/08* (2006.01)
*H01Q 1/12* (2006.01)

(52) U.S. Cl.
CPC ..... *H01Q 1/081* (2013.01); *H01Q 1/1257* (2013.01)

(58) Field of Classification Search
CPC ..... H01Q 1/1264; H01Q 1/1257; H01Q 1/081–1/082; G01S 19/51
USPC ..... 343/915, 761, 881
See application file for complete search history.

(56) References Cited

U.S. PATENT DOCUMENTS 3,170,471 A * 2/1965 Schnitzer ..... E04H 15/20 343/705
3,727,229 A * 4/1973 Clinger ..... H01Q 1/28 116/210
4,364,053 A * 12/1982 Hotine ..... H01Q 1/427 343/840
5,316,002 A * 5/1994 Jackson ..... A61B 5/085 128/898
6,043,777 A * 3/2000 Bergman ..... G01S 19/51 342/357.55
6,208,307 B1 * 3/2001 Frisco ..... H01Q 1/1257 342/363
2002/0140617 A1 * 10/2002 Luly ..... H01Q 19/132 343/781 CA
2003/0090416 A1 * 5/2003 Howell ..... H01Q 1/3275 342/359
2005/0179615 A1 * 8/2005 Mrstik ..... H01Q 1/082 343/915
2005/0248486 A1 * 11/2005 Lee ..... H01Q 3/02 342/359
2009/0158878 A1 6/2009 Clayton et al.
2010/0018595 A1 1/2010 Clayton et al.
2010/0277384 A1 * 11/2010 Gierow ..... H01Q 1/082 343/766

* cited by examiner

*Primary Examiner* — Bernarr Gregory
*Assistant Examiner* — Fred H Mull
(74) *Attorney, Agent, or Firm* — Toler Law Group, PC

(57) ABSTRACT

An apparatus (e.g., a communication assembly) includes a waveform detector operable to detect a waveform. The apparatus also includes a membrane encircling the waveform detector. The membrane has a first portion that is at least partially transparent to the waveform and has a second portion that is at least partially reflective of the waveform. The apparatus also includes a support member coupled to the waveform detector. The support member is configured to moveably support the waveform detector within the membrane at a location that enables the waveform detector to detect a portion of the waveform that is reflected by the second portion of the membrane.

20 Claims, 4 Drawing Sheets

MULTIDIRECTIONAL COMMUNICATION ASSEMBLY

FIELD OF THE DISCLOSURE

The present disclosure is generally related to a communication assembly.

BACKGROUND

Satellite communications systems enable communications to and from locations that are remote from ground-based communication infrastructure. However, portable communication receivers for satellite systems can be bulky or difficult to control and maintain. For example, to maintain communication with a satellite over a period of time, a ground-base antenna may track movement of the satellite relative to the antenna. Systems that allow automatic satellite tracking can be bulky and heavy, making them undesirable for portable communication system. However, light-weight communication systems that do not provide automatic satellite tracking may need to be manually pointed (e.g., periodically moved) to maintain communications. Similarly, changing from communicating via one satellite to communication via a different satellite may require repositioning the communication system manually.

SUMMARY

Particular embodiments disclosed herein provide a compact multidirectional or omnidirectional communication assembly that is lightweight and portable. Further, the communication assembly can automatically maintain a pointing direction to track a satellite as the satellite moves relative to the receiver assembly. The communication assembly is light-weight enough to be portable by a single person and enables rapid deployment of and recovery of the receiver assembly for portable communications.

In another embodiment, an apparatus includes a waveform detector operable to detect a waveform. The apparatus also includes a membrane encircling the waveform detector. The membrane has a first portion that is at least partially transparent to the waveform and has a second portion that is at least partially reflective of the waveform. The apparatus also includes a support member coupled to the waveform detector. The support member is configured to moveably support the waveform detector within the membrane at a location that enables the waveform detector to detect a portion of the waveform that is reflected by the second portion of the membrane.

In another embodiment, a system includes a receiver assembly that includes a waveform detector that is operable to detect a waveform. The receiver assembly also includes a membrane encircling the waveform detector. The membrane has a first portion that is at least partially transparent to the waveform and has a second portion that is at least partially reflective of the waveform. The receiver assembly also includes a support member coupled to the waveform detector. The support member is configured to moveably support the waveform detector within the membrane at a location that enables the waveform detector to detect a portion of the waveform that is reflected by the second portion of the membrane. The system also includes a controller external to the membrane. The controller is configured to control movement of the waveform detector within the membrane.

In another embodiment, a method includes inflating a membrane of a receiver assembly. The membrane encircles a waveform detector of the receiver assembly. The membrane has a first portion that is at least partially transparent to a waveform and has a second portion that is at least partially reflective of the waveform. The method also includes positioning the waveform detector within the membrane. The waveform detector is moveably coupled to a support member, and the waveform detector is positioned to detect a portion of the waveform that is reflected by the second portion of the membrane. The method also includes detecting the waveform at the waveform detector.

The features, functions, and advantages that have been described can be achieved independently in various embodiments or may be combined in yet other embodiments, further details of which are disclosed with reference to the following description and drawings.

DETAILED DESCRIPTION

Figure 1B:
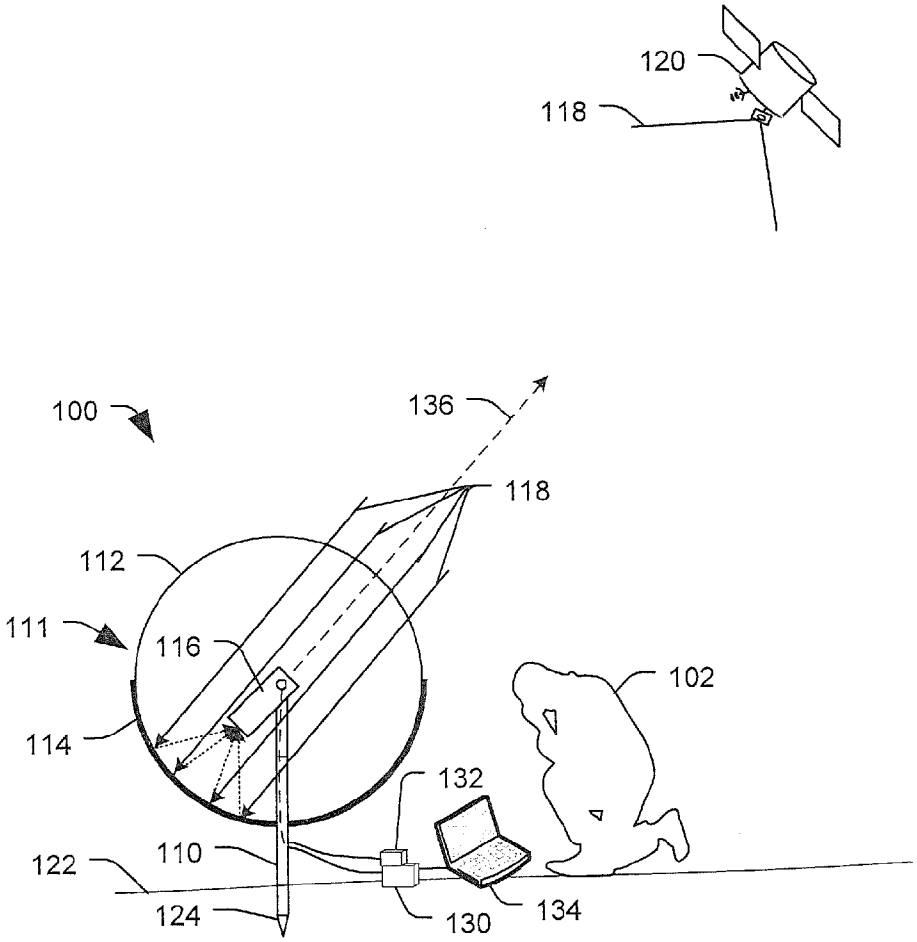
FIG. 1B illustrates the communication system of FIG. 1A in use.
Figure 1A:
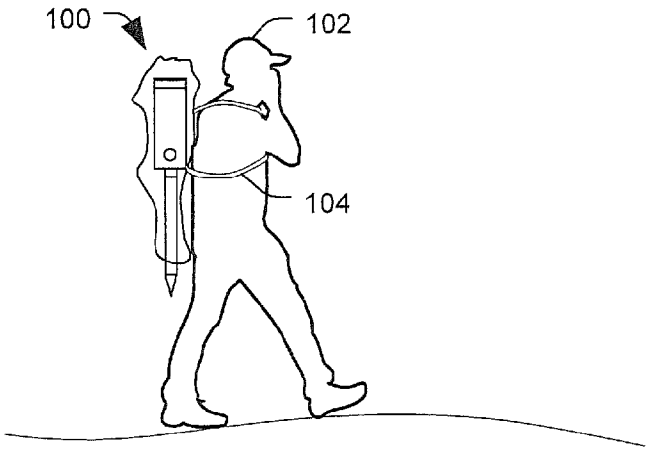
FIG. 1A illustrates a particular embodiment of a communication system in transport.

FIG. 1A illustrates a particular embodiment of a communication system 100 in transport and FIG. 1B illustrates the communication system 100 in use. The communication system 100, which is described in further detail with reference to FIG. 2, includes a membrane 111 that is inflatable to form a roughly spherical shape. A waveform detector 116 resides within the membrane 111 and is movable within the membrane 111 to receive signals 118 from a remote communication system, such as a satellite 120. The communication system 100 may be compact and light-weight, enabling transport by a single user, such as a user 102, without mechanical assistance. For example, the communication system 100 may be mounted to or included on a backpack frame structure 104 to enable portability by a single user over long distances even in rough terrain.

To deploy the communication system 100, the user 102 may anchor the communication system 100 using an anchor portion 124 that is external to the membrane 111. The anchor portion 124 may be a stake or other device that can be inserted into the ground 122. Alternately, or in addition, the anchor portion 124 may include a plurality of legs (e.g., a tripod) or a platform. The anchor portion 124 may include or may be coupled to a support member 110 that passes through the membrane 111 and provides movable support of the waveform detector 116. Thus, the anchor portion 124 may be stationary during use, while moveable components of the support member 110 or moveable components coupled to the support member 110 enable the waveform detector 116 to be repositioned (e.g., for satellite tracking).

The membrane 111 of the communication system 100 may include a first portion 112 (indicated in FIG. 1B as a lighter weight line) and a second portion 114 (indicated in FIG. 1B as a heavier weight line). The first portion 112 of the membrane 111 may be at least partially transparent to a particular waveform. For example, the first portion 112 may be transparent to optical waves, acoustic waves, electromagnetic waves, or other wave energy. To illustrate, the first portion 112 may be substantially (e.g., mostly) or at least partially transparent to a particular frequency range of electromagnetic signals. The second portion 114 of the membrane 111 may be at least partially reflective of the particular waveform. Thus, the second portion 114 of the membrane 111 may reflect at least a portion of particular waves that pass through the first portion 112 of the membrane 111.

For example, in FIG. 1B, a particular waveform, illustrated as the signals 118, is transmitted by the satellite 120. That is, the satellite 120 sends the signals 118 via propagating wave energy. At least a portion of the signals 118 may pass through the first portion 112 of the membrane 111 and may be reflected by the second portion 114 of the membrane 111. The reflected portion of the signals 118 may be reflected toward a focal point or focal region within the membrane 111. The waveform detector 116 may be moved within the membrane 111 such that the waveform detector 116 is directed toward the focal point or focal region of the reflected portion of the signals 118. Thus, the waveform detector 116 is able to detect the signals 118.

In a particular embodiment, the communication system 100 may also include a controller 130. The controller 130 may be operable to control movement of a movable member that is coupled to the waveform detector 116 in order to position the waveform detector 116 within the membrane. The moveable member may include one or more motors, actuators, movement transducers or other movement generating or positioning devices that are coupled to the waveform detector 116 or that are coupled to hinges, gimbals, axes, or other jointed components that are coupled to the waveform detector 116. In a particular embodiment, the support member 110 may be hollow or partially hollow enabling communication lines to pass from the controller 130 to the movable members and/or to the waveform detector 116 within the membrane 111. In another particular embodiment, the controller 130 may communicate with one or more devices within the membrane 111 (e.g., the movable members and/or waveform detector 116) wirelessly, such as by using wireless communications signals that comply with a wireless communication protocol (e.g., Bluetooth, Zigbee, IEEE 802.11, a proprietary protocol, or other protocol).

In a particular embodiment, the communications system 100 may also include a pump 132. The pump 132 may be integral with the controller 130 or may be separate from the controller 130. The pump 132 may be adapted to inflate and/or deflate the membrane 111. When the membrane 111 is inflated, the membrane 111 may form a substantially (e.g., approximately, but with some error due to manufacturing or operational constraints) spherical shape. As described further with reference to FIG. 2, the substantially spherically curved interior of the second portion 114 of the membrane 111 may reflect the signals 118 onto a substantially spherical focal area corresponding to the focal sphere or focal hemisphere 202. The waveform detector 116 may be movable by the movable members, responsive to the controller 130, to sweep the substantially spherical focal area in order to detect reflected portions of the signals 118.

In a particular embodiment, the communications system 100 may include a communication device 134. The communication device 134 may be integral with the controller 130 or may be separate from the controller 130. The communication device 134 may be coupled to the waveform detector 116 directly or via the controller 130. For example, the controller 130 may include a communications port or communications interface adapted to couple to the communication device 134 and may include one or more other interfaces adapted to couple to the movable members that control positioning of the waveform detector 116, to the waveform detector 116, to the pump 132, or any combination thereof. The communication device 134 may enable communication via text, sound and/or images (e.g., still images, graphics, video or a combination thereof). The communication may be one-way (e.g., from the satellite 120 to the communication device 134) or two-way (e.g., from the satellite 120 to the communication device 134 and from the communication device 134 to the satellite 120).

In a particular embodiment, the controller 130 may move (e.g., position) the waveform detector 116 to receive the signals 118 based on an expected direction of arrival of the signals 118. For example, the controller 130 may determine an expected position of the satellite 120 relative to the communication system 100 (e.g., based on orbital information related to the satellite 120 and information about the location of the communication system 100). The controller 130 may move the waveform detector 116 to a position that enables the waveform detector 116 to receive the signals 118 based on the expected position of the satellite 120 relative to the communication system 100.

In a particular embodiment, after the waveform detector 116 is moved to a position based on the expected position of the satellite 120 relative to the communication system 100, the controller 130 may fine tune positioning of the waveform detector 116. For example, the controller 130 may determine a signal strength of the reflected portions of the signals 118 received at the waveform detector 116. The controller 130 may cause the waveform detector 116 to be repositioned in relatively small increments to identify a peak signal strength detected by the waveform detector 116.

The controller 130 may be operable to automatically adjust the position of the waveform detector 116 in order to track the satellite 120 over time. For example, as the satellite 120 moves in orbit, the position of the communication system 100 relative to the satellite 120 may change. In order to maintain communications with the satellite 120, the controller 130 may adjust the position of the waveform detector 116 over time to track the satellite 120. For example, the controller 130 may track the satellite 120 by continuously or occasionally adjusting the position of the waveform detector 116 to track the peak detected signal strength. In another example, the controller 130 may track the satellite 120 using satellite tracking data and algorithms. In another example, the controller 130 may track the satellite 120 using a combination of techniques, such as using satellite tracking data and algorithms for rough positioning (e.g., pointing) and tracking the peak detected signal strength for fine positioning. In a particular embodiment, continuously or occasionally adjusting the position of the waveform detector 116 to track the peak detected signal strength may enable the controller 130 to reduce effects of some signal degrading conditions. For example, the controller 130 may at least partially correct effects of atmosphere turbulence using high-speed repositioning of the waveform detector 116.

In a particular embodiment, the communication system 100 may also include a transmitter 270 (shown in FIG. 2) coupled to or as a portion of the waveform detector 116. The transmitter may be arranged such that when the waveform detector 116 is oriented toward the focal point of the reflected portion of the signals 118, the transmitter is aligned with the satellite 120. Thus, the transmitter may be able to transmit a return signal 136 directly to the satellite 120 without additional manipulation or alignment of the waveform detector 116 or the transmitter. In this embodiment, the communication system 100 may provide full duplex communication, i.e., simultaneous or concurrent transmission and reception.

When the user 102 has completed communication with the satellite 120, the user 102 may signal the controller 130 to prepare the waveform detector 116 for movement. For example, the waveform detector 116 may be moved to a locked position as illustrated in FIG. 1A. The user 102 may also cause the membrane 111 to be deflated, such as by opening a port or other deflation valve of the membrane 111 or the support member 110 or by using the pump 132 to rapidly deflate the membrane 111. The communication system 100 may then be packed for portability as illustrated in FIG. 1A and may be moved to a subsequent location. Thus, the communication system 100 provides a lightweight, inexpensive communication assembly that can rapidly be deployed and recovered.

Figure 2:
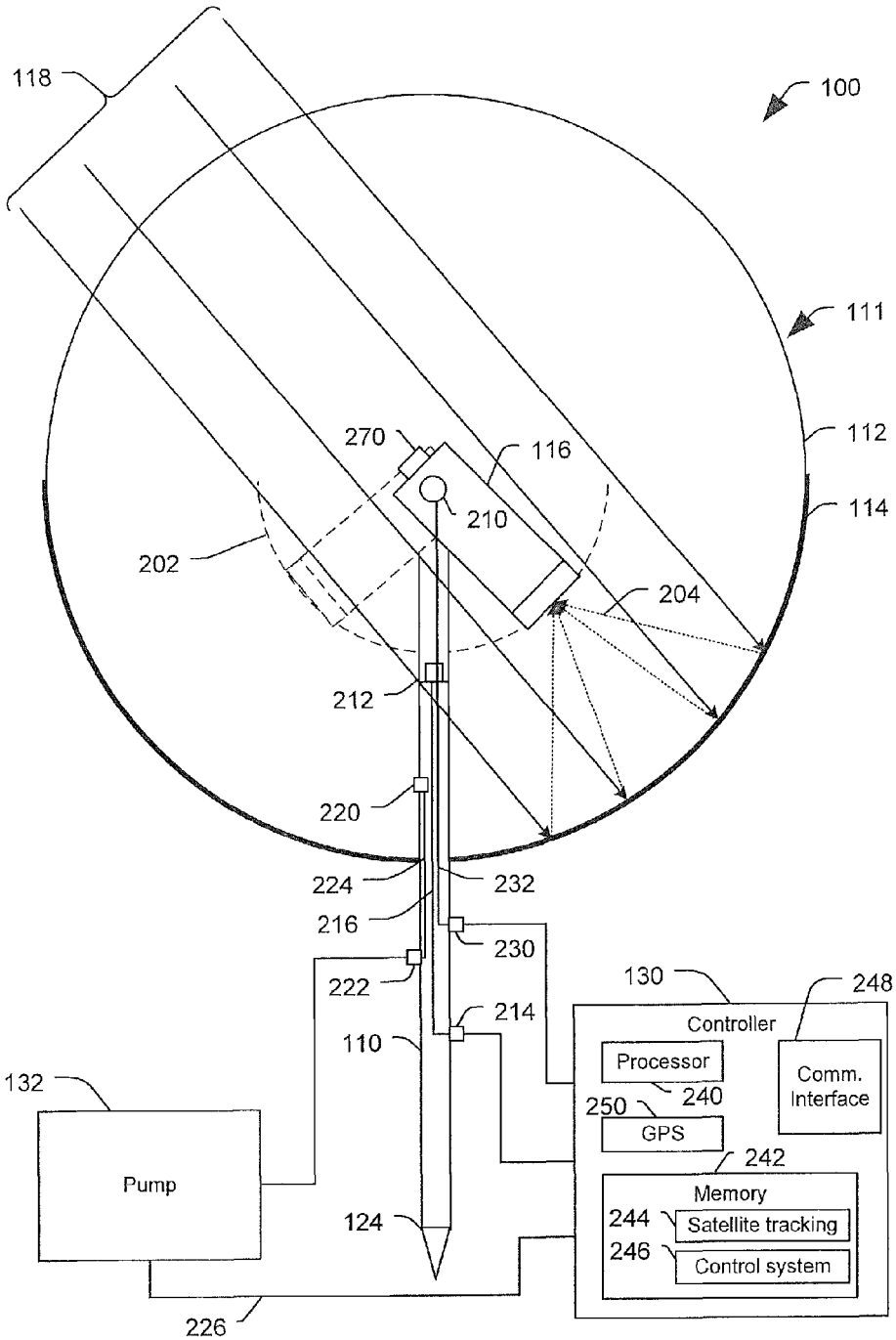
FIG. 2 illustrates a second particular embodiment of the communication system of FIG. 1.

FIG. 2 illustrates a second particular embodiment of the communication system 100. FIG. 2 provides additional detail regarding particular components and structure of the communication system 100. As described with reference to FIGS. 1A and 1B, the communication system 100 includes the membrane 111, which has a first portion 112 that is at least partially transparent to the particular waveform and has a second portion 114 that is at least partially reflective of a particular waveform. The communication system 100 also includes the waveform detector 116 that is operable to detect the particular waveform. The communication system 100 also includes the support member 110, which is coupled to the waveform detector 116 and is configured to movably support the waveform detector 116 within the membrane 111. For example, the support member 110 may support the waveform detector 116 to be positioned at a location that enables the waveform detector 116 to detect a portion of the particular waveform that is reflected by the second portion 114 of the membrane 111. The communication system 100 may also include the controller 130 and the pump 132. The support member 110 may further include the anchor portion 124.

In a particular embodiment, the controller 130 includes a processor 240 and a memory 242. The memory 242 may include data applications or other information used by the processor 240 to control operation of and communication by the communication system 100. In a particular embodiment, the memory 242 includes satellite tracking information 244, which includes information about positions or predicted positions of satellites. The memory 242 may also include a control system 246 for controlling the communication system 100 and components thereof.

The controller 130 may include a communication interface 248. In a particular embodiment, the communication interface 248 is adapted to couple to a communication device, such as the communication device 134 of FIG. 1B, to enable a user to send and/or receive communication signals via the communication system 100. The communication interface 248 may facilitate wired communication, wireless communication, or both, with the communication device. For example, the communication interface 248 may include a jack or receptacle to receive a connector of a communication wire that is coupled to the communication device. In another example, the communication interface 248 may include a transmitter, a receiver or a transceiver that is operable to send wireless signals to the communication device, to receive wireless signals from the communication device, or both. In another embodiment, the communication interface 248 is adapted to communicate directly with the user. For example, the communication interface 248 may include input devices that enable the controller 130 to receive input directly from the user, may include output devices that enable the controller 130 to provide output directly to the user, or may include both input devices and output devices.

In a particular embodiment, the controller 130 may include or may be coupled to the pump 132. For example, the controller 130 may be coupled to the pump 132 via a control line 226. Accordingly, the controller 130 may be able to automatically, or in response to user input, control the pump 132 in order to inflate the membrane 111 to prepare the communication system 100 for use, or in order to deflate the membrane 111 to recover the communication system 100 for transportation.

The controller 130 may be coupled to other components of the communication system 100 via one or more ports, such as a control port 214 and a communication port 230. In a particular embodiment, the control port 214 may be coupled to one or more movable components 210, 212 via one or more conductors 216. The controller 130 may send control signals to the one or more movable components 210, 212 via the control port 214 in order to cause the one or more movable components 210, 212 to position the waveform detector 116 within the membrane 111. The controller 130 may receive communication signals from the waveform detector 116 via the communication port 230 and a conductor 232. In a particular embodiment, the controller 130 may also send communication signals via the communication port 230 and the conductor 232 to a transmitter 270 for transmission.

In a particular embodiment, the one or movable components 210, 212 include motors; movement transducers; actuators; pneumatic, hydraulic, or electrical systems; gimbals; swivels; hinges; axes, joints, or any combination thereof that enable movement of the waveform detector 116 in an azimuth direction (e.g., the second movable component 212) and in an elevation direction (e.g., the first movable component 210). In a particular embodiment, the one or more movable components 210, 212 enable multidirectional or omnidirectional movement of the waveform detector 116. That is, the waveform detector 116 can be pointed at any focal point of a focal sphere or focal hemisphere 202 of the membrane 111.

In the embodiment illustrated in FIG. 2, the support member 110 extends through the membrane 111, and one or more conductors, such as the conductors 216 and 232, pass through the support member 110 to the interior of the membrane 111. Accordingly, the support member 110 may include seals or other components that are airtight to maintain inflation of the membrane 111 during use. In a particular embodiment, the pump 132 may be coupled to the support member 110 via a port 222, and air or other gases to inflate the membrane 111 may be passed via tubing 224 to an interior port 220 to inflate or deflate the membrane 111. In other embodiments, an inflation/deflation port may be located in or through the membrane 111 rather than interior to the membrane 111.

In a particular embodiment, the controller 130 includes a positioning system to determine a location of the communication system 100. For example, the controller 130 may include a global positioning system (GPS) receiver 250. The GPS receiver 250 may be operable to determine the location of the communication system 100 and to provide the location of the communication system 100 to the processor 240. The processor 240 may use the location determined by the GPS receiver 250 and the satellite tracking information 244 to provide information to the control system 246 to direct the waveform detector 116 at a focal point or focal region of the focal sphere or focal hemisphere 202 to receive signals 118 from a particular satellite.

In use, the user 102 may initiate the pump 132 to inflate the membrane 111 and may provide control input to the controller 130 to activate the waveform detector 116. The controller 130 may automatically detect a location of the communication system 100 (e.g., using the GPS receiver 250) and may select a particular satellite for use based on the location (e.g., using the satellite tracking information 244). In another example, a particular satellite to be used may be preselected, may be designated by the user 102, or may be selected based on other criteria, such as confidentiality or a security level associated with particular communications. The processor 240 may use information about the relative position of the communication system 100 and the selected satellite to determine a pointing direction of the waveform detector 116.

The signals 118 from the satellite may pass through the first portion 112 of the membrane 111 and may be reflected by the second portion 114 of the membrane 111, as reflected signals 204 (i.e., a reflected portion of a waveform of the signals 118). The focal point or focal region of the reflected signals 204 depends on an angle of arrival of the signals 118. For example, depending on the angle of arrival of the signals 118, the reflected signals 204 may be focused at a portion of a focal hemisphere 202.

In a particular embodiment, the first portion 112 of the membrane 111 and the second portion 114 of the membrane 111 may be interspersed. For example, the membrane 111 may be entirely reflective with the exception of openings within the reflective membrane that are transparent. In other words, the second portion 114 of the membrane 111 may be continuous and the first portion 112 of the membrane 111 may be discontinuous and distributed over the second portion 114. In another example, the membrane 111 may be entirely transparent with disconnected reflective areas. In other words, the first portion 112 of the membrane 111 may be continuous and the second portion 114 of the membrane 111 may be discontinuous and distributed over the first portion 112. In yet another example, the first portion 112 and the second portion 114 may alternate (e.g., as stripes) or may be arranged in another pattern (e.g., a grid or fractal pattern). When the first portion 112 forms a first hemisphere of the membrane 111 and the second portion forms a second hemisphere of the membrane 111 (as illustrated in FIG. 2), the reflected signals 204 may be focused by the second portion 114 onto a focal hemisphere corresponding to the second hemisphere of the membrane 111 (since only the second hemisphere of the membrane is reflective). However, if the first portion 112 and the second portion 114 are each distributed over the entire membrane 111, the reflected signals 204 may be focused by the second portion 114 onto a focal sphere (since portions of the entire sphere are reflective).

After the membrane 111 has been inflated and the position of the satellite or other communication transmitter sending the signals 118 has been determined, the waveform detector 116 may be positioned within the membrane 111 such that the waveform detector 116 is directed toward a focal point or focal region of the reflected signals 204. For example, the controller 130 may use the satellite tracking information 244 to generate control signals to send to the movable components 210, 212 to cause the waveform detector 116 to be pointed toward the focal point or focal region of the reflected signals 204. In a particular embodiment, the satellite tracking information 244 may be used for coarse pointing of the waveform detector 116, and signal strength of the reflected signals 204 detected by the waveform detector 116 may be used for fine adjustment of the position of the waveform detector 116.

Due to the approximately spherical shape of the membrane 111, the focal point or focal region of the reflected signals 204 may depend on the direction of arrival of the signals 118. Some communication systems may use a parabolic reflector, which may have a single focal point for all rays that travel parallel to an axis of the parabolic reflector (i.e., have a zero angle of incidence relative to the axis). Thus, to maintain the single focal point, the parabolic reflector may have to be moved to ensure that the received rays maintain the zero angle of incidence between the received rays and the axis. By using an approximately spherical reflector (e.g., the second portion 114 of the membrane 111) the communication system 100 generates a focal point or focal region that moves over the focal sphere or focal hemisphere 202 as the angle of arrival of the signals 118 changes. Thus, moving the waveform detector 116 over the focal sphere or focal hemisphere enables reception of the reflected signals 204 regardless of the direction of arrival of the signals 118 without moving other components of the communication system 100 (e.g., the membrane 111). The focal sphere or focal hemisphere 202 corresponds to a plurality of focal points or focal regions of the second portion 114 of the membrane 111. The one or more movable components 210, 212 may be configured to rotate the waveform detector 116 to sweep the waveform detector over this focal sphere or focal hemisphere 202 of the second portion 114 of the membrane 111.

After the waveform detector 116 is moved to a position that corresponds to a focal point or focal region of the reflected signals 204, based on the satellite tracking information 244, the signal strength of the reflected signals 204 detected by the waveform detector 116 may be used to fine-tune positioning of the waveform detector 116. That is, the satellite tracking information 244 may be used as a coarse adjustment of the pointing direction of the waveform detector 116 and signal strength detected by the waveform detector 116 may be used as fine adjustment of the pointing direction. In a particular embodiment, the transmitter 270 may be coupled to the waveform detector 116 in a manner that causes the transmitter 270 to be aligned with a remote communication system (e.g., a satellite) sending the signals 118 when the waveform detector 116 is aligned to receive the reflected signals 204.

In a particular embodiment, the signals 118 may include communication signals. The signals 118 may utilize propagating wave energy, such as optical waves (e.g., optical communication signals), other electromagnetic waves, acoustic waves, or other waves, such as matter waves. The waveform detector 116 may be operable to detect the reflected signals 204. The waveform detector 116 may provide an electrical signal that corresponds to the reflected signals 204 detected by the waveform detector 116 to the controller 130. Thus, the waveform detector 116 and the membrane 111 together may be referred to as a receiver assembly or a communication assembly. The receiver assembly may also include other components that enable the waveform detector 116 and the membrane 111 to work together, such as the one or more movable components 210, 212 that position the waveform detector 116 to receive the reflected signals, the support member 110 that supports the waveform detector 116, other components of the communication system 100, or combinations thereof.

The controller 130 may be operable to process the electrical signal received from the waveform detector 116 to generate an output corresponding to the electrical signal. The controller 130 may provide the output to a communication device that is external to the membrane 111. For example, a communication device may be coupled to the communication interface 248. In a particular embodiment, the communication device coupled to the communication interface 248 may also send outgoing signals to the controller 130, which may provide the outgoing signals to the transmitter 270. The transmitter 270 may transmit outgoing communication signals to a remote communication system (e.g., a satellite) when the waveform detector 116 is aligned to receive the reflected signals 204.

During communications, the controller 130 may use the satellite tracking information 244 (e.g., predicted satellite location information) to track the position of the satellite and to adjust the position of the waveform detector 116 within the membrane 111 in order to facilitate reception of the signals 118. Alternately, or in addition, signal strength of the reflected signals 204 detected by the waveform detector 116 may be used to fine-tune or adjust satellite tracking in order to maintain communications.

Accordingly, the communication system 100 provides a human portable, inexpensive, rapidly deployable and recoverable system to provide communications, such as satellite communications, in remote areas. Since the communication system 100 uses an approximately spherically shaped reflector, such as the second portion 114 of the membrane 111, to generate a focal sphere or focal hemisphere 202, the waveform detector 116 can be movable within the membrane 111 to sweep over the focal sphere or focal hemisphere 202 to receive communication signals. Thus, a receiver assembly of the communication system 100 can be anchored (e.g., at a single anchor point via the anchor portion 124) and can remain anchored throughout use for communications and satellite tracking.

Figure 3:
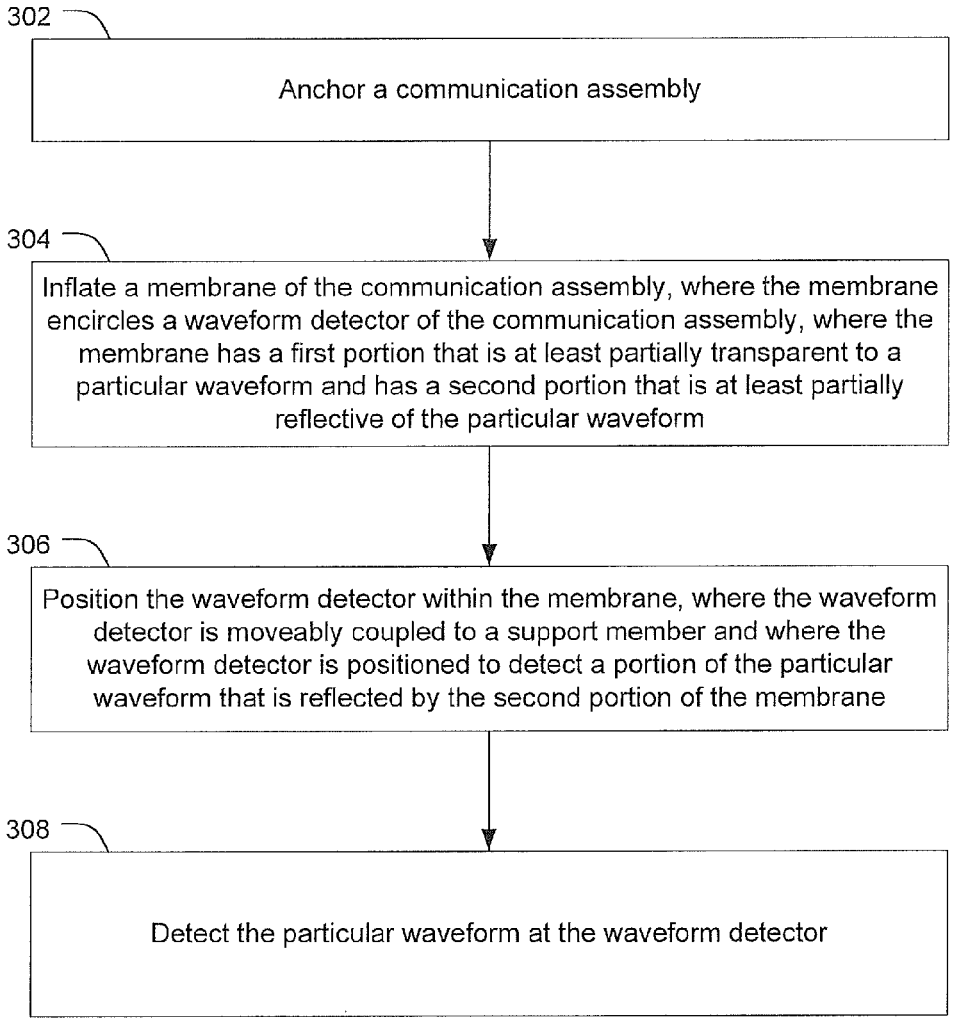
FIG. 3 illustrates a particular embodiment of a method of using a portable communication system.

FIG. 3 illustrates a particular embodiment of a method of using a portable communication system, such as the communication system 100 of FIGS. 1A, 1B and 2. The method includes, at 302, anchoring a communication assembly. For example, the communication assembly may include the membrane 111, the waveform detector 116, the support member 110, and the anchor portion 124 of FIGS. 1A, 1B and 2.

The method may also include, at 304, inflating the membrane of the communication assembly. The membrane may encircle the waveform detector of the communication assembly. The membrane may have a first portion that is at least partially transparent to a particular waveform and may have a second portion that is at least partially reflective of the particular waveform. The waveform detector may be configured to receive the particular waveform.

The method may also include, at 306, positioning the waveform detector within the membrane. For example, the waveform detector 116 may be automatically positioned responsive to a control system, such as the controller 130 of FIGS. 1B and 2. The waveform detector may be movably coupled to the support member and may be positioned to detect a portion of the particular waveform that is reflected by the second portion of the membrane.

The method may also include, at 308 detecting the particular waveform at the waveform detector. The waveform detector may process the detected waveform and output an electrical signal corresponding to the particular waveform. For example, the waveform may be a communication signal, such as an optical signal, an acoustic signal, an electromagnetic signal, or another propagating wave carrying data. The waveform detector may provide the electrical signal to a communication device in order to facilitate communications by a user.

Figure 4:
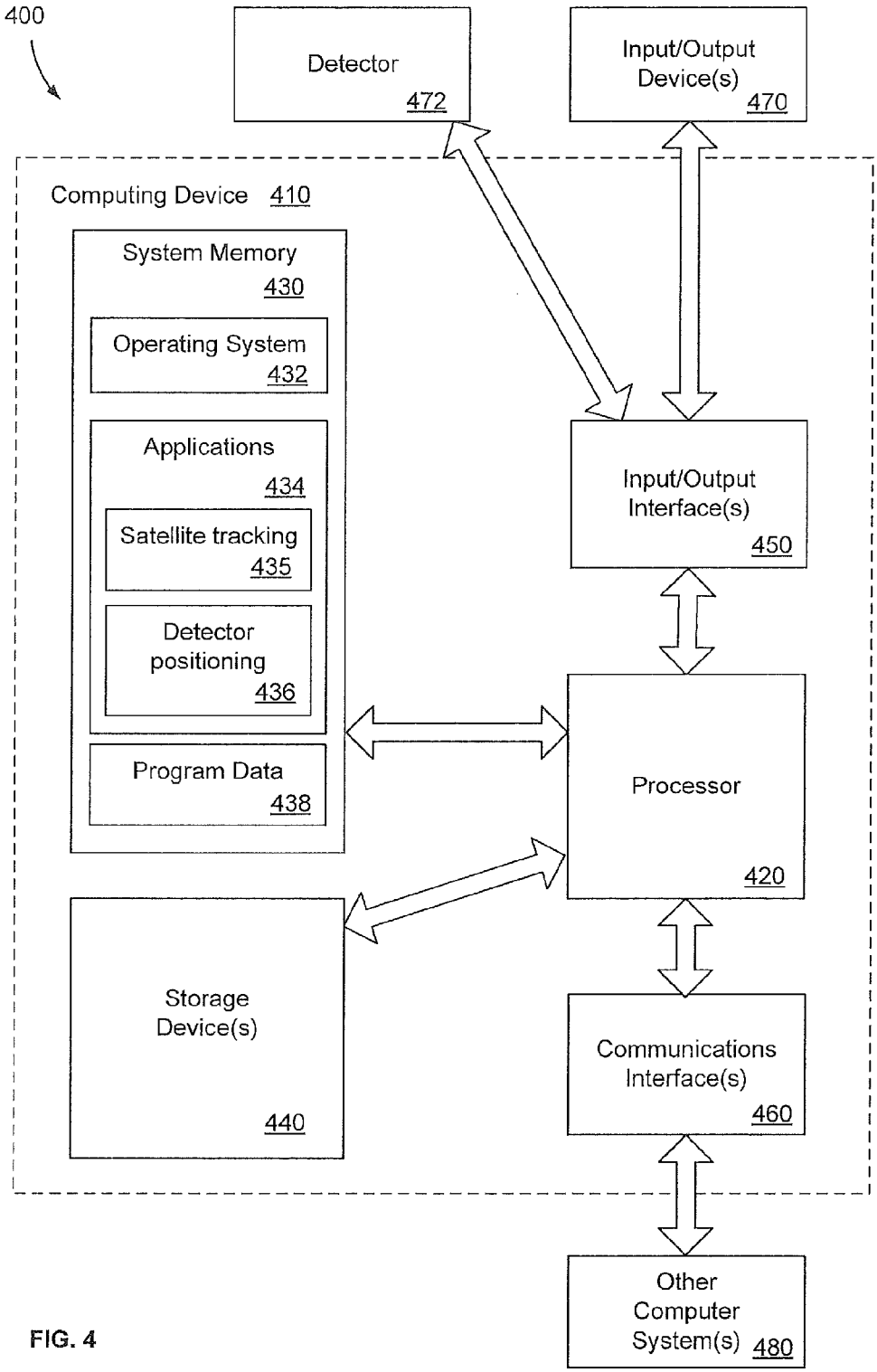
FIG. 4 illustrates a particular embodiment of a computing system, such as a controller of a portable communication system.

FIG. 4 is a block diagram of a computing environment 400 including a general purpose computing device 410 operable to support communications. For example, the computing device 410, or portions thereof, may correspond to the controller 130 or the communication device 134 of FIGS. 1B and 2.

The computing device 410 may include at least one processor 420. Within the computing device 410, the at least one processor 420 may communicate with a system memory 430, one or more storage devices 440, one or more input/output interfaces 450, one or more communications interfaces 460, or a combination thereof.

The system memory 430 may include volatile memory devices (e.g., random access memory (RAM) devices), nonvolatile memory devices (e.g., read-only memory (ROM) devices, programmable read-only memory, and flash memory), or both. The system memory 430 may include an operating system 432, which may include a basic input/output system for booting the computing device 410 as well as a full operating system to enable the computing device 410 to interact with users, other programs, and other devices. The system memory 430 may also include one or more applications 434, such as a satellite tracking application 435, and a detector positioning application 436. For example, the satellite tracking application 435 may include information to facilitate determination of a relative position of a satellite. To illustrate, the satellite tracking application 435 may include or may correspond to the satellite tracking information of FIG. 2. The detector positioning application 436 may include information used to select a pointing direction of a waveform detector and to generate control signals to point the waveform detector. To illustrate, the detector positioning application 436 may include or correspond to the control system 246 of FIG. 2. The system memory 430 also may include program data 438. The program data 438 may include data used by the applications 434 to perform respective functions of the applications 434.

The at least one processor 420 may also communicate with one or more storage devices 440. For example, the one or more storage devices 440 may include nonvolatile storage devices, such as magnetic disks, optical disks, or flash memory devices. The storage devices 440 may include both removable and non-removable memory devices. The storage devices 440 may be configured to store an operating system, applications and program data. In a particular embodiment, the system memory 430, the storage devices 440, or both, include tangible, non-transitory computer-readable media. The storage devices 440 may store data used by one or more of the applications 434.

The at least one processor 420 may also communicate with one or more input/output interfaces 450. The one or more input/output interfaces 450 may enable the computing device 410 to communicate with one or more input/output devices 470 to facilitate user interaction. For example, the one or more input/output interfaces 450 may be adapted to receive input from the user, to receive input from another computing device, such as a global positioning system device, or a combination thereof. The input/output interfaces 450 may include serial interfaces (e.g., universal serial bus (USB) interfaces or IEEE 494 interfaces), parallel interfaces, display adapters, audio adapters, and other interfaces. The input/output devices 470 may include buttons, keyboards, pointing devices, displays, speakers, microphones, touch screens, sensors, and other devices. The input/output interfaces 450 may also facilitate communication of control signals to components of a communication assembly. For example, the at least one processor 420 may send control signals to a detector 472 (such as the waveform detector 116 of FIGS. 1A, 1B and 2) via the input/output interfaces 450.

The at least one processor 420 may communicate with other computer systems 480 and/or other devices (e.g., the communication device 134 of FIGS. 1B and 2) via the one or more communications interfaces 460. The one or more communications interfaces 460 may include wired Ethernet interfaces, IEEE 802.X wireless interfaces, Bluetooth communication interfaces, electrical, optical or radio frequency interfaces, or other wired or wireless interfaces. The other computer systems 480 may include host computers, servers, workstations, portable computers, telephones, tablet computers, or any other communication device.

Embodiments described above illustrate but do not limit the disclosure. It should also be understood that numerous modifications and variations are possible in accordance with the principles of the present disclosure. Accordingly, the scope of the disclosure is defined only by the following claims.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. For example, method steps may be performed in a different order than is shown in the figures or one or more method steps may be omitted. Accordingly, the disclosure and the figures are to be regarded as illustrative rather than restrictive.

Moreover, although specific embodiments have been illustrated and described herein, it should be appreciated that any subsequent arrangement designed to achieve the same or similar results may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, the claimed subject matter may be directed to less than all of the features of any of the disclosed embodiments.

What is claimed is:

1. An apparatus comprising:

a waveform detector operable to detect a waveform;

a membrane encircling the waveform detector, the membrane having a first portion that is at least partially transparent to the waveform and having a second portion that is at least partially reflective of the waveform;

a support member having a first end for mounting the waveform detector and the membrane at a location and having a second end opposite the first end and inside the membrane coupled to the waveform detector, wherein the support member is configured to support, at the second end, the waveform detector within the membrane;

one or more movable components coupled to the support member and to the waveform detector, wherein the one or more movable components are configured to move the waveform detector relative to the support member;

a controller external to the membrane, the controller configured to control movement of the waveform detector, via the one or more movable components, to align the waveform detector with a focal point of the waveform within a focal area of the membrane, and a transmitter coupled to a first side of the waveform detector such that the transmitter is aligned with a remote communication system sending the waveform when a second side of the waveform detector is aligned with the focal point.

2. The apparatus of claim 1, wherein the membrane is inflatable to form an approximately spherical shape, wherein the first portion comprises a first approximately hemisphere shape of the approximately spherical shape that is substantially transparent to the waveform, wherein the second portion comprises a second approximately hemisphere shape of the approximately spherical shape that is substantially reflective of the waveform, and wherein when the membrane is inflated, the second portion of the membrane is operable to reflect at least a portion of the waveform toward the focal area, wherein a location of the focal area depends on a direction of arrival of the waveform.

3. The apparatus of claim 2, further comprising a pump to inflate the membrane.

4. The apparatus of claim 1, further comprising a pump to inflate the membrane, wherein the controller is further configured to automatically control the pump to cause the pump to inflate the membrane or to deflate the membrane, and when the membrane is inflated to automatically control movement of the waveform detector inside the membrane.

5. The apparatus of claim 1, wherein the one or more movable components are configured to move the waveform detector to sweep the waveform detector over the focal area, wherein the focal area corresponds to a plurality of focal points of the second portion of the membrane, wherein a reflected portion of the waveform is focused to a focal point of the focal area depending on a direction of arrival of the waveform.

6. The apparatus of claim 1, wherein the one or more movable components include a first movable member operable to move the waveform detector in an azimuth direction and a second movable member operable to move the waveform detector in an elevation direction.

7. The apparatus of claim 1, wherein the waveform includes optical waves, acoustic waves, or matter waves, and wherein the waveform detector is operable to generate an electrical signal corresponding to the waveform and to send the electrical signal to a communication device coupled to the waveform detector.

8. The apparatus of claim 1, wherein satellite tracking data or detector positioning information enables the controller to cause the one or more movable components to move the waveform detector relative to the support member for coarse positioning and fine positioning, wherein the coarse positioning is based on at least one of a predicted satellite location and global positioning system data corresponding to a global location of the wave detector, and wherein the fine positioning is based upon a peak detected signal strength of a signal received at the waveform detector.

9. The apparatus of claim 1, wherein the controller is configured to automatically control the one or more movable components to move the waveform detector relative to the support member via wireless communications signals that comply with a wireless communication protocol.

10. The apparatus of claim 1, wherein the first portion and the second portion are arranged in a grid pattern, wherein the first portion and the second portion are arranged in a fractal pattern, wherein the second portion is continuous and the first portion is discontinuous and distributed over the second portion, or wherein the first portion is continuous and the second portion of the membrane is discontinuous and distributed over the first portion.

11. The apparatus of claim 1, wherein the transmitter coupled to the waveform detector inside the membrane is configured to enable simultaneous or concurrent transmission of a return signal by the transmitter and reception of a reflected portion of the waveform by the waveform detector.

12. The apparatus of claim 11, wherein the one or more movable components include one or more motors within the membrane.

13. The apparatus of claim 1, wherein the one or more movable components include one or more motors, actuators, or movement transducers, and wherein the support member is at least partially hollow and includes a communication line coupling the controller to the one or more movable components, the waveform detector, or both, within the membrane.

14. A system comprising:

a communication assembly comprising:

a waveform detector operable to detect a waveform;

a membrane encircling the waveform detector, the membrane having a first portion that is at least partially transparent to the waveform and having a second portion that is at least partially reflective of the waveform;

a support member having a first end for mounting the communication assembly at a location and having a second end opposite the first end and inside the membrane coupled to the waveform detector, wherein the support member is configured to support, at the second end, the waveform detector within the membrane; and one or more movable components coupled to the waveform detector and coupled to the support member, wherein the one or more movable components are configured to move the waveform detector relative to the support member;

a controller external to the membrane, the controller configured to control movement of the waveform detector, via the one or more movable components, to align the waveform detector with a focal point of the waveform within a focal area of the membrane; and a transmitter coupled to a first side of the waveform detector such that the transmitter is aligned with a remote communication system sending the waveform when a second side of the waveform detector is aligned with the focal point.

15. The system of claim 14, further comprising a satellite tracking system coupled to the controller, wherein the satellite tracking system is operable to provide predicted satellite location information to the controller to enable the controller to automatically control movement of the waveform detector such that the waveform detector is able to detect the waveform from a satellite.

16. The system of claim 14, wherein the controller is electrically coupled to the one or more movable components via one or more conductors, wherein the one or more conductors are routed through the membrane within the support member, wherein the one or more movable components include one or more motors, and wherein the support member if configured to couple the controller to the one or more movable components, the waveform detector, or both.

17. The system of claim 14, further comprising a communication device external to the membrane, the communication device operable to receive, from the waveform detector, a signal corresponding to the waveform and to generate an output corresponding to the signal.

18. The system of claim 14, further comprising:

an anchor portion that is external to membrane and coupled to the support member, wherein the anchor portion is configured to inserted into a surface of a ground; and a backpack frame structure, the backpack frame structure configured to enable, without mechanical assistance, portability of the communication assembly by a single user over long distances in rough terrain.

19. A method comprising:

anchoring first end of a support member of a communication assembly at a location, the support member extending inside of a membrane of the communication assembly;

inflating the membrane of the communication assembly, wherein the membrane encircles a waveform detector of the communication assembly, the waveform detector movably mounted at a second end of the support member inside the inflated membrane, wherein the membrane has a first portion that is at least partially transparent to a waveform and has a second portion that is at least partially reflective of the waveform, and wherein the support member is stationary with respect to the inflated membrane;

positioning the waveform detector, relative to the support member, to align a first side of the waveform detector with a focal point of a waveform and to align a transmitter coupled to a second side of the waveform detector with a source of the waveform, and wherein the waveform detector is positioned to detect a portion of the waveform that is reflected by the second portion of the membrane; and detecting the waveform at the waveform detector.

20. The method of claim 19, wherein anchoring the first end of the support member of the communication assembly includes anchoring the first end via a single anchor point.

* * * * *